US010327468B2

(12) United States Patent
Scholl

(10) Patent No.: US 10,327,468 B2
(45) Date of Patent: Jun. 25, 2019

(54) SYSTEM AND METHODS FOR IMPARTING FLAVOR IN LIQUID FILTRATION INHALATION APPARATUSES

(71) Applicant: Sebastian Scholl, Sunny Isles Beach, FL (US)

(72) Inventor: Sebastian Scholl, Sunny Isles Beach, FL (US)

( * ) Notice: Subject to any disclaimer, the term of this patent is extended or adjusted under 35 U.S.C. 154(b) by 23 days.

(21) Appl. No.: 15/730,724

(22) Filed: Oct. 11, 2017

(65) Prior Publication Data

US 2019/0104761 A1 Apr. 11, 2019

(51) Int. Cl.

| | |
|---|---|
| ***A24F 1/30*** | (2006.01) |
| ***A24B 15/16*** | (2006.01) |
| ***A24B 15/42*** | (2006.01) |
| ***A24F 1/14*** | (2006.01) |

(52) U.S. Cl.

CPC ..... *A24B 15/167* (2016.11); *A24B 15/42* (2013.01); *A24F 1/14* (2013.01)

(58) Field of Classification Search

CPC ..... A24F 1/30
USPC ..... 426/591
See application file for complete search history.

(56) References Cited

U.S. PATENT DOCUMENTS

| | | | | | |
|---|---|---|---|---|---|
| 4,155,868 | A * | 5/1979 | Kaplan | A61K 8/11 | 424/53 |
| 4,357,948 | A * | 11/1982 | Schweitzer | A24F 1/30 | 131/173 |
| 4,568,560 | A * | 2/1986 | Schobel | A61K 8/922 | 424/401 |
| 2006/0272658 | A1* | 12/2006 | Mehio | A24F 1/30 | 131/173 |
| 2009/0053366 | A1* | 2/2009 | Hurwitz | A23L 2/38 | 426/73 |
| 2010/0034889 | A1* | 2/2010 | Rau | A23L 2/395 | 424/489 |
| 2010/0252057 | A1* | 10/2010 | Saleh | A24F 1/30 | 131/275 |
| 2011/0281008 | A1* | 11/2011 | Gootenilleke | A61K 9/0007 | 426/548 |
| 2015/0053221 | A1* | 2/2015 | Asghar-Sheikh | A24F 1/30 | 131/329 |
| 2015/0068540 | A1* | 3/2015 | Hoch | A24F 1/32 | 131/328 |

* cited by examiner

*Primary Examiner* — Eric Yaary
(74) *Attorney, Agent, or Firm* — Diana Mederos; DiSchino & Schamy, PLLC

(57) ABSTRACT

A system and methods for imparting flavor in liquid filtration inhalation apparatus. The system comprises a liquid filtration inhalation apparatus with a liquid reservoir that receives at least one liquid and at least one tablet capable of effervescence. The tablet can contain flavoring, coloring, or fragrance that is mixed in with the liquid. A user heats plant material to cause smoke which is drawn into the reservoir, and through the liquid via inhalation.

1 Claim, 2 Drawing Sheets

SYSTEM AND METHODS FOR IMPARTING FLAVOR IN LIQUID FILTRATION INHALATION APPARATUSES

FIELD OF THE DISCLOSURE

The present disclosure relates to systems and methods for imparting flavor in liquid filtration inhalation apparatuses. More specifically, the disclosure pertains to improving smoking experiences by allowing for convenient and customizable flavor, fragrance, or color enhancements by adding a temporarily effervescent tablet to a liquid-filled reservoir in the liquid filtration inhalation apparatus.

BACKGROUND OF THE DISCLOSURE

Smoking plant matter such as tobacco is a popular pastime and social activity. Plant matter is traditionally raised, harvested, dried, processed, and then implemented in an inhalation apparatus. Traditional inhalation apparatuses include cigarettes, cigars, and pipes. The plant matter is heated with fire to cause combustion, resulting in smoke. The smoke is inhaled by a user. The smoke inhaled may be filtered or unfiltered.

More elaborate inhalation apparatuses include water pipes such as hookahs and bongs that use water to filter out and cool the harsh smoke particles before the smoke or aerosol is inhaled. These water pipes are traditionally used in social settings and in some bars and restaurants. Usually, a group of users will share one water pipe.

In the example of hookahs, tobacco is selected by the group for a session usually lasting about 60 to 90 minutes before the tobacco is re-packed or replaced. Hookah tobacco is traditionally flavored by saturating the dried tobacco leaves in a syrup of molasses and/or propylene glycol containing flavoring additives. The group is limited to a single flavor for the hookah session.

Nevertheless, the hookah experience can be enhanced by adding or substituting juice, milk, wine, coffee, soda pop, or liquor for water in the hookah base. The smoke is drawn through the liquid which affects the taste, smell, and texture of the smoke. For example, milk is known to have a cooling and smoothing effect, and orange juice is used to complement fruit flavored tobacco.

Using carbonated beverages such as soda pop in the hookah base typically does not improve the flavor or enhance the smoking experience. Carbonated beverages are too saturated with carbon dioxide to where it can take at least an hour for the carbonation to dissipate, rendering the soda pop flat. The carbonation can result in a bitter taste, make the smoke feel harsher in the mouth and throat, and can cause a user to inhale carbonated liquid. Also, effervescent tablets, such as the popular Alka-Seltzer effervescent antacid, generally do not have long-lasting flavoring effects appropriate for typical hookah sessions.

Syrups, concentrates, elixirs, and drops can be added to water in a hookah base, but separate mixing is required. This can cause a delay in receiving a prepared hookah pipe and requires additional materials. Furthermore, the additive may not be adequately mixed in with the liquid and results in greater user error in calculating the appropriate volumes and concentrations for flavor and/or fragrance enhancement.

SUMMARY OF THE DISCLOSURE

What is needed is a system and methods for conveniently and quickly imparting flavor in liquid filtration inhalation apparatuses to enhance the smoking experience. The system comprises a liquid filtration apparatus having a reservoir, an outlet, an opening, a plant matter chamber, and a mouthpiece integrated with a tablet and a liquid in the reservoir and a heating element and plant matter integrated with the plant matter chamber.

The tablet comprises an anhydrous base such as sodium bicarbonate, an anhydrous acid such as citric acid, a fruit or a vegetable oil, and either coloring, flavoring, or fragrance or combinations thereof. In some embodiments, some of the coloring, flavoring, or fragrance is encapsulated so as to allow for delayed release in the liquid. In some embodiments, the tablet remains in the effervescent phase from about 10 to about 90 seconds. The temporary effervescence prevents a user from inhaling liquid that bubbles up from excessive release of carbon dioxide but still effectuates quick, homogenous mixing or distribution of the tablet components in the liquid.

Flavor is imparted by providing a liquid filtration apparatus having a reservoir, an outlet, an opening, a plant matter chamber, and a mouthpiece used in connection with a tablet containing coloring, fragrance, or flavoring; a liquid; a heating element; and plant matter. The reservoir is filled between one half and three quarters full with at least one liquid. The tablet is placed into the liquid in the reservoir through the opening to initiate an effervescent phase of the tablet. The effervescent phase of the tablet is engaged whereby the tablet comprising an anhydrous acid and an anhydrous base reacts in the liquid to release carbon dioxide for a period from about 10 to about 90 seconds. The dissolved phase is engaged whereby the tablet and its coloring, fragrance, or flavoring is dissolved in the liquid and effervescence is no longer observed. The plant matter is placed in the plant matter chamber connected to the liquid filtration inhalation apparatus and heated directly or indirectly with a heat source to cause combustion which causes smoke. A user draws the smoke into the reservoir and through the liquid via inhalation to cause mixing of the smoke with coloring, fragrance, or flavoring particles dissolved in the liquid, resulting in a flavored smoke aerosol. The flavored smoke aerosol is inhaled.

BRIEF DESCRIPTION OF THE DRAWINGS

The accompanying drawings that are incorporated in and constitute a part of this specification, illustrate exemplary embodiments of the disclosure and, together with the description, serve to explain the principles of the disclosure.

DETAILED DESCRIPTION

The system and methods for imparting flavor in liquid filtration inhalation apparatuses allow users to quickly and effectively enhance their smoking experience. A compact and portable tablet is placed in liquid held in reservoir in the liquid filtration inhalation apparatus. The tablet effervesces, substantially dissolving and distributing the tablet contents throughout the liquid. Plant material in a chamber of the liquid filtration inhalation apparatus is heated, causing combustion and formation of smoke. A user, via inhalation from mouthpiece at an opening of the liquid filtration inhalation apparatus, draws the smoke into and through the liquid. The liquid filters components from the smoke as well as imparts flavor and fragrance to the resulting smoke aerosol.

Glossary

"Liquid filtration apparatus" as used herein means a device capable of accommodating a reservoir filled with a liquid and connected to an outlet, an opening, and a plant matter chamber. Examples include water pipes, hookahs, bongs, and vaporizers.

"Tablet" as used herein means a compacted ball, pellet, pill, tablet, chip, slice, or film containing an anhydrous base and an anhydrous acid capable of dissolving and releasing carbon dioxide when in water.

"Liquid" as used herein means any compound or element in the liquid phase. Examples include water, wine, beer, spirits, milk, fruit juice, vegetable juice, coffee, carbonated soda pop, energy beverage, and combinations thereof.

"Heating element" as used herein means a heat source capable of resulting in combustion of plant matter and generation of smoke. Examples include matches, hot coals, lighters, and torches.

"Plant matter" as used herein means any plant matter suitable for smoking. Examples include tobacco, passionflower, sage, and hops.

"Fragrance" as used herein means compounds capable of producing an aroma and may be part of flavoring compounds. Examples include natural or synthetic aromatic or volatile oils such as linalool.

NUMBERS OF THE FIGURES

Figure 1:
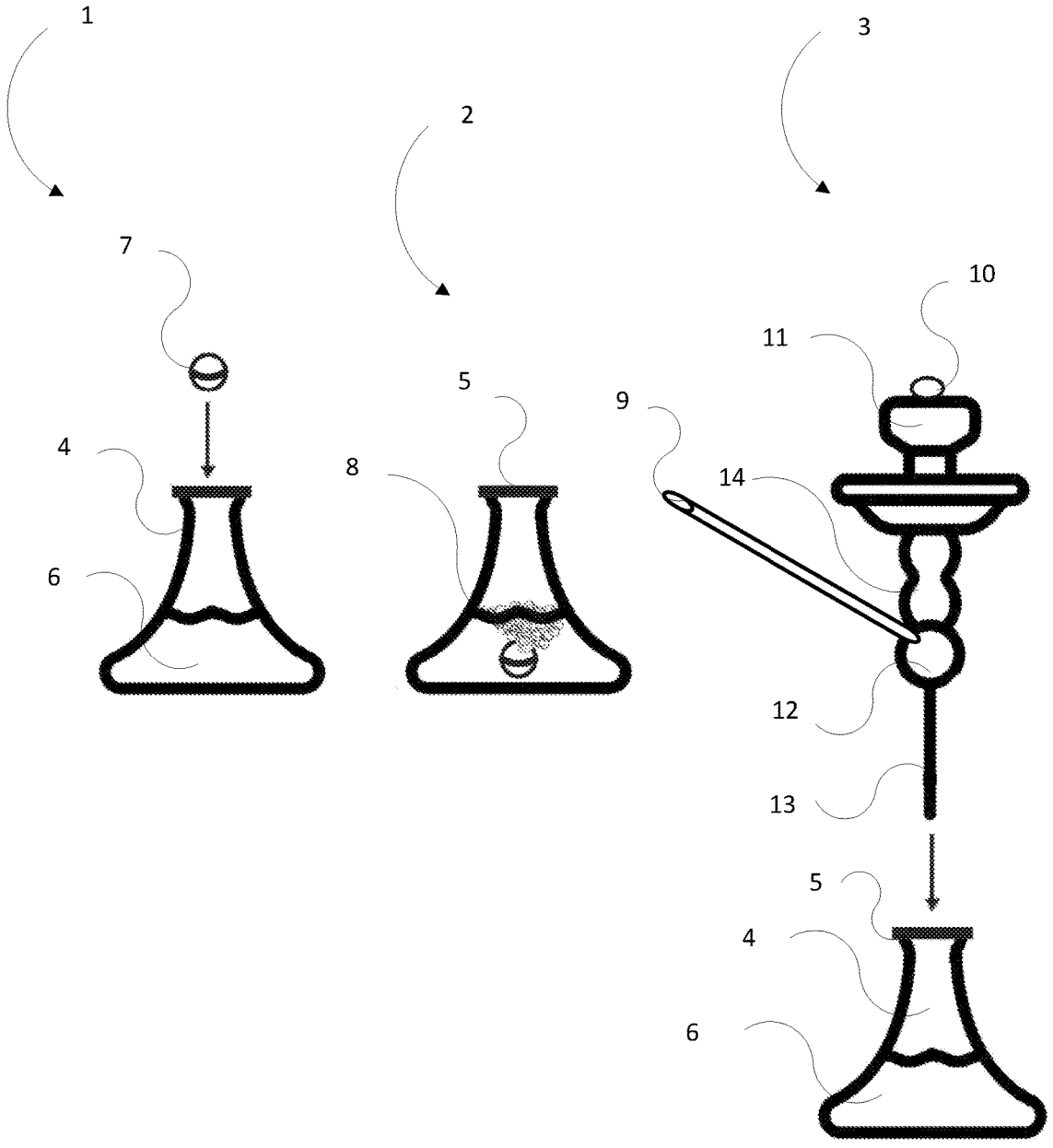
FIG. 1 illustrates an exemplary system for imparting flavor in a liquid filtration inhalation apparatus.

1. liquid filtration apparatus without tablet.
2. liquid filtration apparatus with tablet in effervescent phase.
3. liquid filtration apparatus with tablet in dissolved phase.
4. reservoir
5. opening
6. liquid
7. tablet
8. effervescence
9. mouthpiece
10. heating element
11. plant matter chamber with plant matter
12. outlet
13. stem
14. top Descriptions Turning to FIG. 1, an exemplary system for imparting flavor in a liquid filtration inhalation apparatus is illustrated. A liquid filtration apparatus without tablet 1 is shown, depicting the initial stage of the system and methods. The liquid filtration apparatus contains a reservoir 4. The reservoir 4 is capable of holding a volume of liquid 6. The reservoir 4 can be filled fully or partially with liquid 6. In some embodiments, the reservoir 4 is filled ½, ¼, ⅔, or ¾ of the way with at least one liquid 6. In preferred embodiments, the reservoir should have enough space filled with air to allow the passage and mixing of aerosols, smoke, release of carbon dioxide bubbles, and room for bubbling and aerating caused by inhalation from a mouthpiece 9.

The liquid filtration apparatus comprises at least one opening 5 to allow aeration and access to inhalation for drawing smoke through the liquid 6 and out through the opening 5 and to the user. In some embodiments, inhalation may occur directly from an opening 5 or from a mouthpiece 9 fixably or removably attached to the liquid filtration apparatus. In some embodiments, a top 14 with a stem 13 may be attached to the liquid filtration apparatus via the opening 5. The top 14 may accommodate a plant matter chamber with plant matter 11 and a heating element 10 arranged linearly. The stem 13 provides for more direct movement of smoke from the plant matter chamber with plant matter 11 at the top 14 to the reservoir 4, through the liquid 6, and out through an outlet 12. The outlet may accommodate a mouthpiece 9 such as a pipe or hose. The outlet 12 may be present at the reservoir 4 but above the liquid 6 level or may be present at the top 14 and may be removable.

The plant matter chamber with plant matter 11 may be fixably or removably attached. Removable parts such as the plant matter chamber with plant matter 11, top 14, and stem 13, should create a substantially air-tight seal when attached to the reservoir 4 to promote efficient direction and filtration of smoke and aerosols. The plant matter chamber with plant matter 11 may be an open or closed system whereby the plant matter is covered or exposed. The plant matter chamber with plant matter 11 is preferably shaped like a bowl, cone, cube, or other walled structure with a hollow center. The plant matter chamber with plant matter 11 should contain at least one opening to allow smoke from the combusted plant matter to be drawn into the reservoir 4. The heating element 10 may be applied directly to plant matter or may be applied indirectly to plant matter wherein the plant matter chamber with plant matter 11 is covered. The covering should include at least one opening or perforation to allow for combustion of the plant matter and access to air.

A liquid filtration apparatus with tablet in effervescent phase 2 is illustrated. The tablet 7 produces effervescence 8 in the reservoir 4 when the tablet is in contact with water. The mixture of the anhydrous base and anhydrous acid of the tablet 7 in water or a liquid with a substantially neutral pH will result in the production of carbon dioxide. Flavor, fragrance, or color is released and mixed in with the liquid during the effervescent phase 2.

A liquid filtration apparatus with tablet in dissolved phase 3 is illustrated. The effervescence should be substantially finished, and the liquid 6 should be relatively flat rather than have the appearance of highly carbonated soda pop. The liquid 6 should not be saturated with carbon dioxide. The contents of the tablet 7 should be substantially evenly mixed or distributed in the liquid 6.

Figure 2:
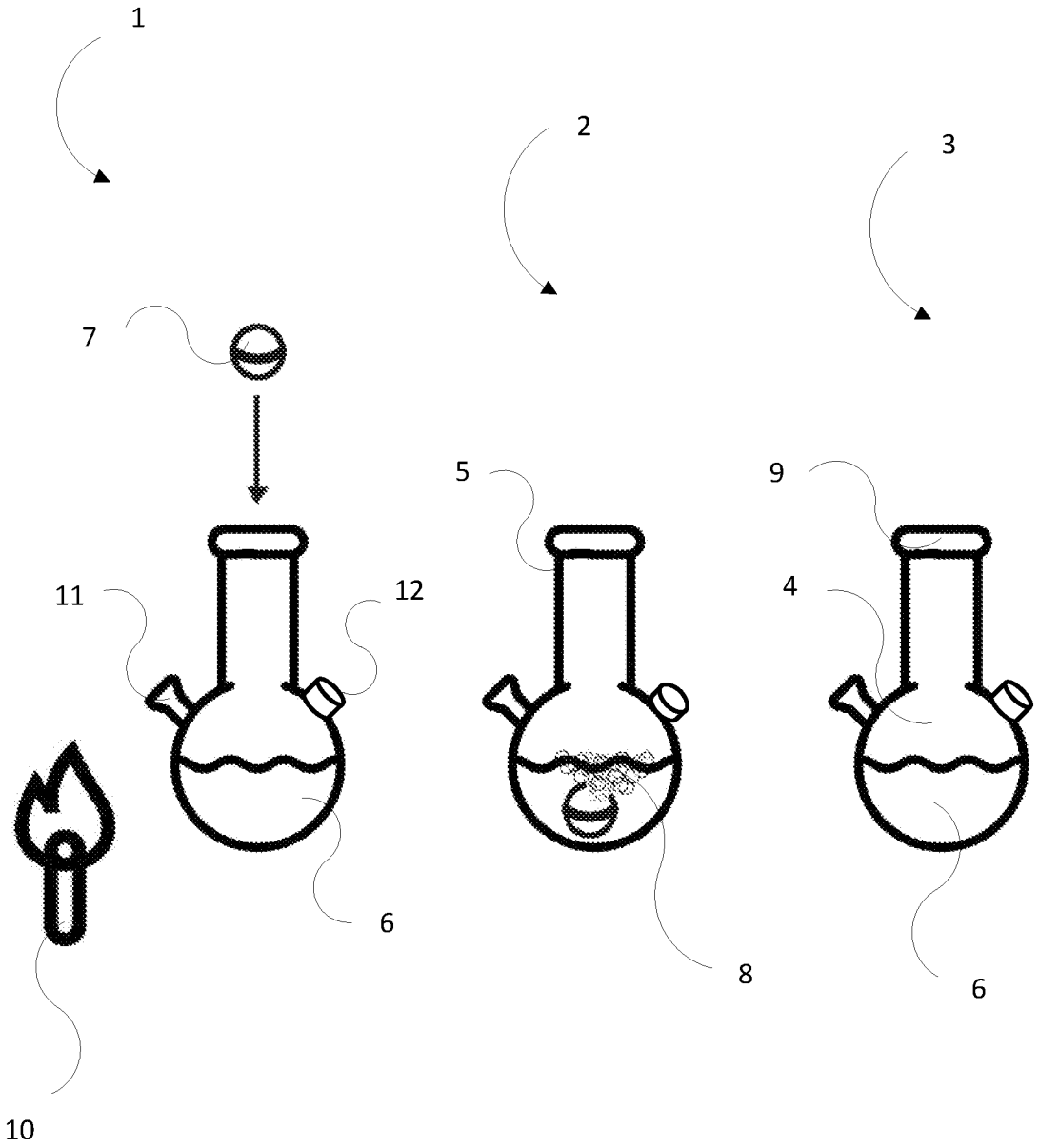
FIG. 2 illustrates an alternative exemplary system for imparting flavor in a liquid filtration inhalation apparatus.

Turning to FIG. 2, an alternative exemplary system for imparting flavor in a liquid filtration inhalation apparatus is illustrated. The exemplary system and apparatuses show a liquid filtration system with a removable plant matter chamber with plant matter 11, an outlet 12 as part of the reservoir 4, and an opening 5 whereby the mouthpiece 9 is directly part of the liquid filtration apparatus. The heating element 10, is applied directly to the plant matter chamber with plant matter 11. The liquid filtration apparatus without tablet 1, liquid filtration apparatus with tablet in effervescent phase 2, and liquid filtration apparatus with tablet in dissolved phase 3 is illustrated.

An exemplary tablet may contain an anhydrous base, an anhydrous acid, and either a fruit or vegetable oil in a ratio of approximately 4 to 2 to 1, respectively. An exemplary tablet batch formula may comprise about 667 grams of sodium bicarbonate, about 354 grams of citric acid, and about 91 grams of fractionated coconut oil. Another exemplary tablet may comprise about 500 mg of an anhydrous base, about 250 mg of an anhydrous acid, and about 125 mg of oil. Fragrance, flavor, and color may be added such as two drops of food coloring and 1.25 ounces of grapefruit essential oil. Natural and synthetic flavor, fragrance, and color may be added to the tablet. Coloring includes pigments and dyes such as food coloring. The oil used should preferably contain short or medium chain triglycerides. The contents are mixed to a soft, loose paste, divided, compressed in a mold or by a tablet compression machine, and set to harden.

Fillers and additives may be included in compositions for a tablet 7. Examples include coloring, emulsifiers, herbs, spices, propylene glycol, algae-derived compounds, silicone-containing compounds, natural or synthetic sweeteners, polymer hydrogels, humectants such as corn starch, cooling agents such as menthol or oil of wintergreen.

Some fillers, additives, flavoring, coloring, or fragrance compounds may be encapsulated in granules for delayed release. Lipids, chitosan, or algae-based polymers such as carrageenan or sodium alginate may encapsulate the fillers, additives, flavoring, coloring, or fragrance. This allows for extended smoking enjoyment with a reduction in carbon dioxide saturation in the liquid 6, and a reduction in bitter taste compared to traditional effervescent tablets. Traditional effervescent tablets are not suitable for social smoking sessions because they have long effervescent phases, saturating the liquid with carbon dioxide, and have flavor lasting less than 30 minutes. For example, the encapsulated compounds may be released at least once or several times during a dissolved phase 3, such as in 10-minute intervals or once after 30 minutes, or once every 30, 20, 15, or 5 minutes. The delayed release time will differ depending on the thickness of the encapsulation according to traditional molecular gastronomy standards.

Many flavor and fragrance compounds, especially if derived from volatile essential oils, have relatively low persistence and may not effectively dissolve in the liquid 6 in the reservoir 4. The fruit or vegetable oil in the tablet creates an emulsion with the liquid 6 in a continuous phase and the oil in the dispersed phase. The oil serves to both improve filtration of lipophilic compounds from the smoke and to improve persistence of the lipophilic flavoring and fragrance compounds. The flavor or fragrance in the liquid filtration apparatus with tablet in the dissolved phase 3 may last from about 3 to about 120 minutes depending on the size and concentration of the components in the tablet 7. Exemplary tablets may weigh between approximately 0.2 grams to approximately 20 grams. A 5 to 10 gram tablet may be suitable for a standard hookah reservoir for example. Additional tablets 7 may be added to the liquid 6 simultaneously or sequentially for further enhancement, intensity, complement, and customization for individual tastes, especially where a group of users share a liquid filtration apparatus.

The effervescence activity in the liquid filtration apparatus with tablet in effervescent phase 2, promotes the mixing and dispersion of the tablet 7 contents in the liquid without the need for additional stirring equipment. Flavor and fragrance will be more evenly distributed, resulting in greater surface area available for smoke exposure. The smoke will mix with the tablet 7 components in the liquid 6, imparting flavor for user enjoyment. The effervescent phase may last from about 10 to about 90 seconds. Examples may be 20, 30, or 60 seconds, providing temporary effervescence to reduce excessive bubbling and reduction of inhaling liquid.

Conclusion

A number of embodiments of the present disclosure have been described. While this specification contains many specific implementation details, specific exemplary embodiments and method step descriptions are features specific to particular embodiments of the present disclosure and do not limit the scope of the claims.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order or arrangement shown, or sequential order described, to achieve desirable results. Nevertheless, it will be understood that various modifications may be made without departing from the spirit and scope of the claimed disclosure.

What is claimed is:

1. A method of imparting flavor in liquid filtration inhalation apparatuses, the method steps comprising:

Providing a liquid filtration apparatus having a reservoir, an outlet, an opening, a plant matter chamber, and a mouthpiece;

a tablet comprising sodium bicarbonate, citric acid, and fractionated coconut oil, and containing coloring, fragrance, or flavoring;

a liquid;

a heating element; and plant matter;

whereby the liquid filtration apparatus is prepared for receiving the tablet by

Filling the reservoir between one half and three quarters full with at least one liquid;

Placing the tablet into the liquid in the reservoir through the opening to initiate an effervescent phase of the tablet;

Engaging the effervescent phase of the tablet whereby the tablet comprising an anhydrous acid and an anhydrous base reacts in the liquid to release carbon dioxide for a period from about 10 to about 90 seconds;

Engaging a dissolved phase whereby the tablet and its coloring, fragrance, or flavoring is dissolved in the liquid, and effervescence is no longer observed;

Placing plant matter in the plant matter chamber connected to the liquid filtration inhalation apparatus;

Heating the plant matter directly or indirectly with a heat source to cause combustion which causes smoke;

Drawing the smoke into the reservoir and through the liquid via inhalation to cause mixing of the smoke with coloring, fragrance, or flavoring particles dissolved in the liquid, resulting in a flavored smoke aerosol; and Inhaling the flavored smoke aerosol.

* * * * *